US006848234B2

(12) United States Patent
Sung et al.

(10) Patent No.: US 6,848,234 B2
(45) Date of Patent: Feb. 1, 2005

(54) SEALING MACHINE

(75) Inventors: Han-jun Sung, Suwon (KR); Jong-wook Lee, Yongin (KR); Tae-uk Lee, Suwon (KR); Jae-ryong Park, Suwon (KR)

(73) Assignee: Samsung Electronics, Co., Ltd., Suwon-Si (KR)

( * ) Notice: Subject to any disclaimer, the term of this patent is extended or adjusted under 35 U.S.C. 154(b) by 0 days.

(21) Appl. No.: 10/382,649

(22) Filed: Mar. 7, 2003

(65) Prior Publication Data

US 2004/0011003 A1 Jan. 22, 2004

(30) Foreign Application Priority Data

Jul. 19, 2002 (KR) ..... 2002-42595

(51) Int. Cl.[7] ..... B65B 51/10

(52) U.S. Cl. ..... 53/374.9; 53/284.7; 53/384.1; 53/570

(58) Field of Search ..... 53/79, 151, 268, 53/284.7, 371.8, 371.9, 373.7, 374.8, 374.9, 384.1, 564, 570; 156/583.9

(56) References Cited

U.S. PATENT DOCUMENTS

| | | | | |
|---|---|---|---|---|
| 2,696,336 A | | 12/1954 | Drunen | |
| 3,106,630 A | * | 10/1963 | Klamp | 156/583.9 |
| 3,323,714 A | | 6/1967 | Lewis | |
| 3,375,777 A | * | 4/1968 | Techtmann et al. | 53/374.9 |
| 3,699,742 A | * | 10/1972 | Giraudi | 53/374.8 |
| 3,771,578 A | * | 11/1973 | Huff | 141/314 |
| 3,866,390 A | | 2/1975 | Moreland, II et al. | |
| 3,983,994 A | | 10/1976 | Wyslotsky | |
| 4,021,290 A | * | 5/1977 | Smith | 156/583.9 |
| 4,229,244 A | | 10/1980 | Swope | |
| 4,322,932 A | * | 4/1982 | McGregor | 53/284.7 |
| 4,396,383 A | | 8/1983 | Hart | |
| 4,423,583 A | * | 1/1984 | Carey | 53/384.1 |
| 4,548,606 A | | 10/1985 | Larkin | |
| 4,823,538 A | | 4/1989 | Takamura | |
| 5,005,341 A | * | 4/1991 | Tetenborg | 53/570 |
| 5,048,269 A | * | 9/1991 | Deni | 53/374.9 |
| 5,352,323 A | * | 10/1994 | Chi | 156/583.9 |
| 5,638,664 A | * | 6/1997 | Levsen et al. | 53/374.8 |
| 6,467,242 B1 | * | 10/2002 | Huang | 53/374.9 |

FOREIGN PATENT DOCUMENTS

| | | |
|---|---|---|
| EP | 0295204 A1 | 12/1988 |
| GB | 1026133 | 4/1966 |
| KR | 20-168962 | 11/1999 |
| KR | 10-320525 | 12/2001 |
| WO | WO 99/25467 | 5/1999 |

* cited by examiner

*Primary Examiner*—Louis Huynh
(74) *Attorney, Agent, or Firm*—Staas & Halsey, LLP

(57) ABSTRACT

A sealing machine for sealing a pack filled with one or more objects, including a main case; a first sealing member provided in the main case; a second sealing member facing the first sealing member; a movable supporting part supporting the second sealing member and allowing the second sealing member to move near to, and away from, the first sealing member; and a heater provided in at least one of the first sealing member and the second sealing member to heat and melt the pack interposed therebetween.

16 Claims, 7 Drawing Sheets

SEALING MACHINE

CROSS-REFERENCE TO RELATED APPLICATIONS

This application claims the benefit of Korean Application No. 2002-42595, filed Jul. 19, 2002, in the Korean Intellectual Property Office, the disclosure of which is incorporated herein by reference.

BACKGROUND OF THE INVENTION

1. Field of the Invention

The present invention relates to a sealing machine sealing a pack filled with one or more objects.

2. Description of the Related Art

Generally, a container made of, for example, vinyl material (hereinafter referred to as "a pack") is widely used for preserving food such as raw fish, soup, etc. The pack is filled with the food, and then sealed by a rubber band, for example, to preserve the food from spoilage due to activity of microorganisms in air and to prevent the smell of the food from leaking out.

For certain cookers, a user buys a sealed pack filled with predetermined food, and puts the pack into the cooker without breaking the seal of the pack to cook the food using the cooker. For example, for a bread maker disclosed in PCT WO 99/25467, the manufacturer of the bread maker sells a sealed pack filled with previously assorted raw materials (ingredients) for bread, and the bread maker makes the bread using the sealed pack without breaking the seal of the pack before cooking.

However, it is difficult to suit the raw materials previously assorted by the manufacturer to a user's various tastes. If a user opens the sealed pack to add additional raw materials to the sealed pack, it is difficult to reseal the opened pack. Generally, the manufacturer seals the pack using a large and complicated sealing machine, but the large and complicated sealing machine is inadequate for home use or for a retailer.

SUMMARY OF THE INVENTION

It is an aspect of the present invention to provide a sealing machine by which anyone can easily seal a pack and easily insert an object into the pack.

Additional aspects and advantages of the invention will be set forth in part in the description that follows, and, in part, will be obvious from the description, or may be learned by practice of the invention.

To achieve the above and/or other aspects according to the present invention, there is provided a sealing machine for sealing a pack filled with one or more objects, including a main case; a first sealing member provided in the main case; a second sealing member facing the first sealing member; a movable supporting part supporting the second sealing member and allowing the second sealing member to move near to, and away from, the first sealing member; and a heater provided in at least one of the first sealing member and the second sealing member to heat and melt the pack interposed therebetween.

The sealing machine further includes a pair of grip parts between the first and second sealing members to grip the pack.

The heater is provided in the first sealing member.

The first sealing member and the second sealing member are supported by the main case and the movable supporting part, respectively, and the movable supporting part is rotatably combined to the main case to allow the second sealing member to move near to, and away from, the first sealing member.

The grip parts are each placed in upper opposite sides of the main case, and move near to and away from each other as the second sealing member moves away from and near to the first sealing member.

The grip parts move away from the first sealing member as the grip parts approach each other, and move near to the first sealing member as the grip parts move away from each other.

The sealing machine further includes gearing parts connecting the movable supporting part to the grip parts, and rotating the grip parts to move away from each other when the second sealing member moves toward the first sealing member.

Each gearing part includes a hinge pin protruding from a lower end of the movable supporting part, and a gearing member sliding up and down on a side wall of the main case, each gearing member includes a slot at a lower end of each gearing member and an inclined part at an upper end of each gearing member, each hinge pin being accommodated by a corresponding slot, as the movable supporting part rotates, the rotating motion of the movable supporting part is transformed into a sliding motion of each gearing member, and each inclined part contacts a corresponding grip part to transform the sliding motion of each gearing member into a rotating motion of each grip part.

The sealing machine further includes a first spring elastically biasing each grip part to approach one another.

The sealing machine further includes a second spring between the movable supporting part and the second sealing member to elastically bias the second sealing member toward the first sealing member.

The sealing machine further includes an injection member partially placed in a mouth of the pack to insert the one or more objects into the pack when the grip parts are positioned near each other; and a rotatable supporting member having a first end combined with the injection member, and a second end rotatably combined with the main case to rotatably support the injection member.

The injection member has two outlets to evenly insert the one or more objects into the pack.

The pack has at least one hole at an end part thereof, and the grip parts have at least one projection corresponding to and receiving the at least one hole of the pack to attach the pack to the grip parts when the grip parts are rotated near each other.

To achieve the above and/or other aspects according to the present invention, there is provided a gear assembly for a sealing machine that seals a pack filled with one or more objects, the sealing machine including a first sealing member and an adjacent second sealing member provided in a movable supporting part rotatably connected to the sealing machine, the gear assembly including gearing members positioned at opposite ends of the sealing machine, each gearing member having an inclined part at a top end and a slot at a bottom end; grip members each having a bent shape and a grip part with projections at one end and a hinge part with an elastic member at another end, each hinge part being connected to the sealing machine and the projections combining with holes in an upper end of the pack, and each elastic member biasing each grip part toward the second sealing member and toward one another; and hinge pins each protruding from opposite ends of the movable supporting part and being accommodated by a corresponding slot, wherein as the movable supporting part rotates the second sealing member toward the first sealing member, each hinge pin moves a corresponding gearing member down to contact a corresponding grip member, moving each grip part toward the first sealing member and away from one another.

To achieve the above and/or other aspects according to the present invention, there is provided a dispensing apparatus for a sealing machine that seals a pack filled with one or more objects, the dispensing apparatus including a funnel; and a rotatable handle having one end connected to the funnel and another end rotatably connected to a back of the sealing machine, the rotatable handle being rotated toward a front of the sealing machine and the funnel being placed in a top of the pack to dispense objects into the pack, and the rotatable handle being rotated away from the front of the sealing machine when the pack is being sealed.

These together with other aspects and advantages which will be subsequently apparent, reside in the details of construction and operation as more fully hereinafter described and claimed, reference being had to the accompanying drawings forming a part thereof, wherein like numerals refer to like parts throughout.

BRIEF DESCRIPTION OF THE DRAWINGS

These and other aspects and advantages of the present invention will become apparent and more readily appreciated from the following description of the embodiments, taken in conjunction with the accompany drawings, of which.

DETAILED DESCRIPTION OF THE PREFERRED EMBODIMENT

Figure 1:
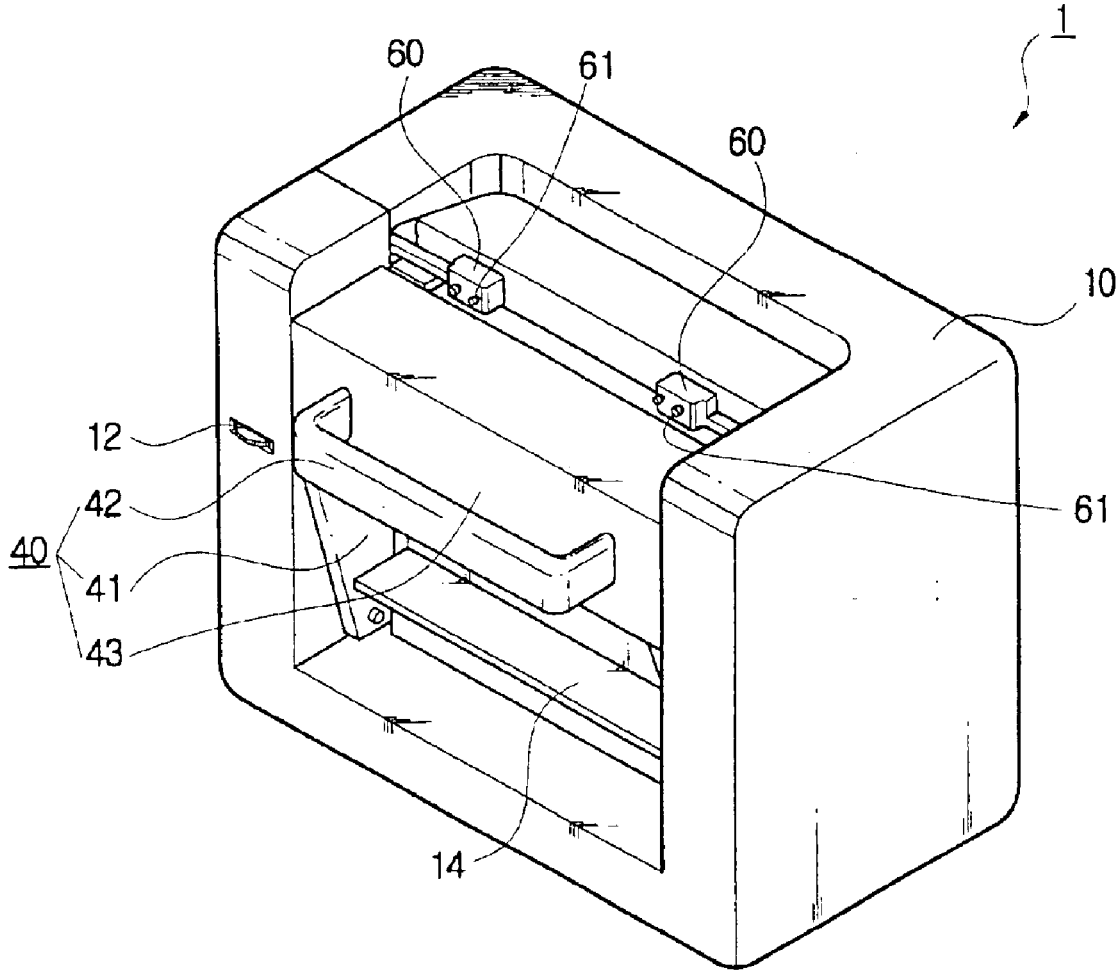
FIG. 1 is a perspective view of a sealing machine according to an embodiment of the present invention.

Hereinafter, embodiments of the present invention will be described in detail with reference to the attached drawings, wherein the like reference numerals refer to the like elements throughout. The present invention may, however, be embodied in many different forms and should not be construed as being limited to the embodiments set forth herein; rather, these embodiments are provided so that the present disclosure will be thorough and complete, and will fully convey the concept of the invention to those skilled in the art.

Figure 2:
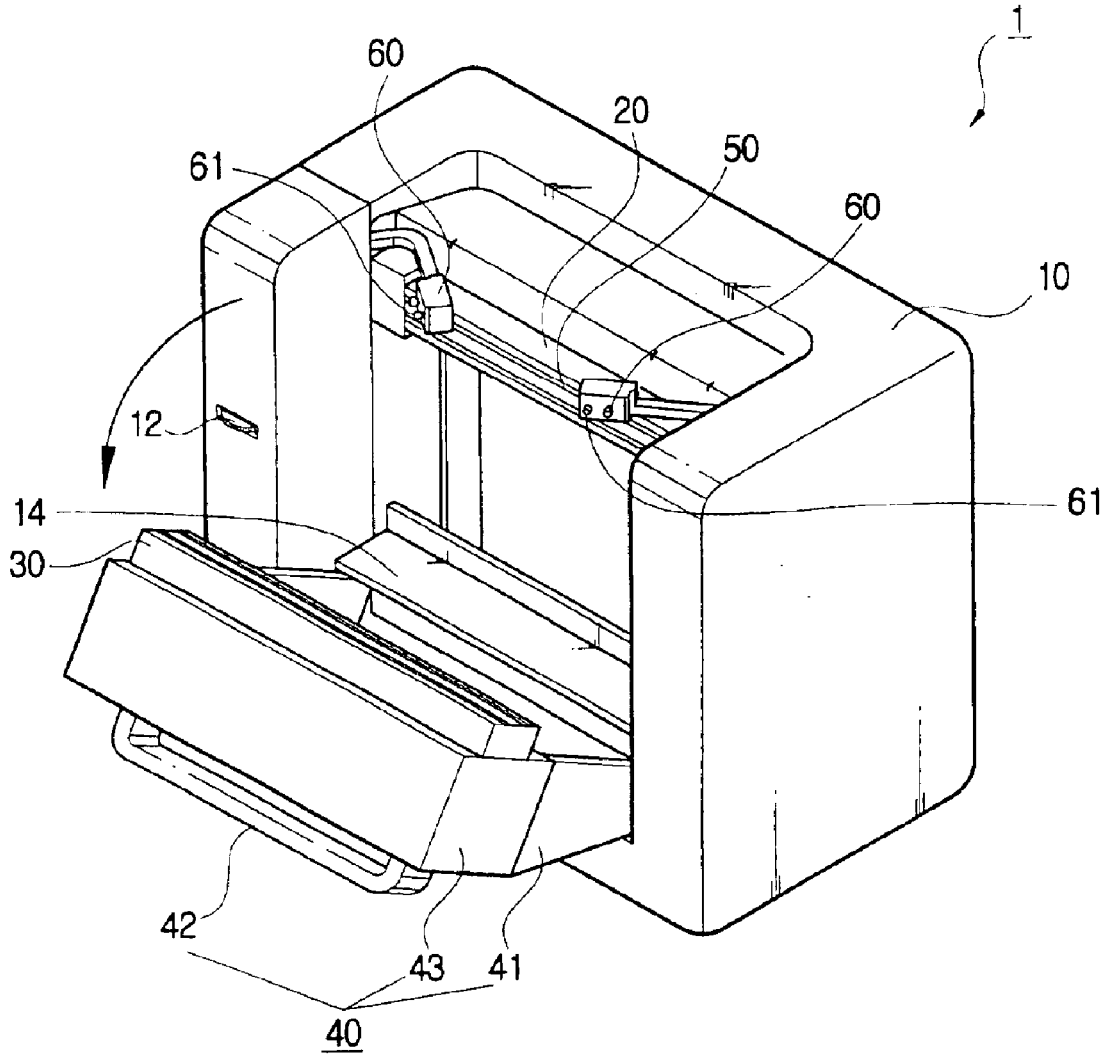
FIG. 2 illustrates the sealing machine of FIG. 1, with a second sealing member separated from a first sealing member.

As shown in FIGS. 1 and 2, a sealing machine 1 according to an embodiment of the present invention comprises a main case 10; a first sealing member 20 provided in the main case 10; a second sealing member 30 facing the first sealing member 20; a movable supporting part 40 supporting the second sealing member 30 and allowing the second sealing member 30 to move near to, and distantly from, the first sealing member 20; a heater 50 provided in at least one of the first and second sealing members 20 and 30 for heating and melting a pack 90 (refer to FIG. 6), which is interposed between the first and second sealing members 20 and 30; and a pair of grip parts 60 between the first and second sealing members 20 and 30 for gripping the pack 90.

An opening is formed in the main case 10 by rotatably moving the second sealing member 30 away from the first sealing member 20, through which the pack 90 is inserted and removed. The main case 10 forms an outer enclosure of the sealing machine 1. Inside a lower part of the main case 10 is a shelf 14 protruding forward and supporting the bottom of the pack 90 when the pack 90 is gripped by the grip parts 60.

The second sealing member 30 is provided in the movable supporting part 40 in correspondence to the first sealing member 20. The movable supporting part 40 is rotatably combined to the main case 10 to move the second sealing member 30 near to, and distantly from, the first sealing member 20. The movable supporting part 40 includes a main block 43 mounted with the second sealing member 20, and a pair of hinge brackets 41 extending from the lower part of the main block 43 and rotatably connected to first hinge parts 11 (FIG. 3) provided in opposite inner walls of the main case 10, thereby allowing the second sealing member 30 to move near to, and distantly from, the first sealing member 20.

In this embodiment, the movable supporting part 40 is rotatably combined with the main case 10. However, the movable supporting part 40 may be slidingly combined with the main case 10 by a guide rail (not shown) provided in the main block 43, so that the second sealing member 30 slides forward and backward to move near to, and distantly from, the first sealing member 20.

The movable supporting part 40 has a handle 42 in the front of the main block 43, thereby allowing a user to easily grasp and rotate the movable supporting part 40.

Figure 3:
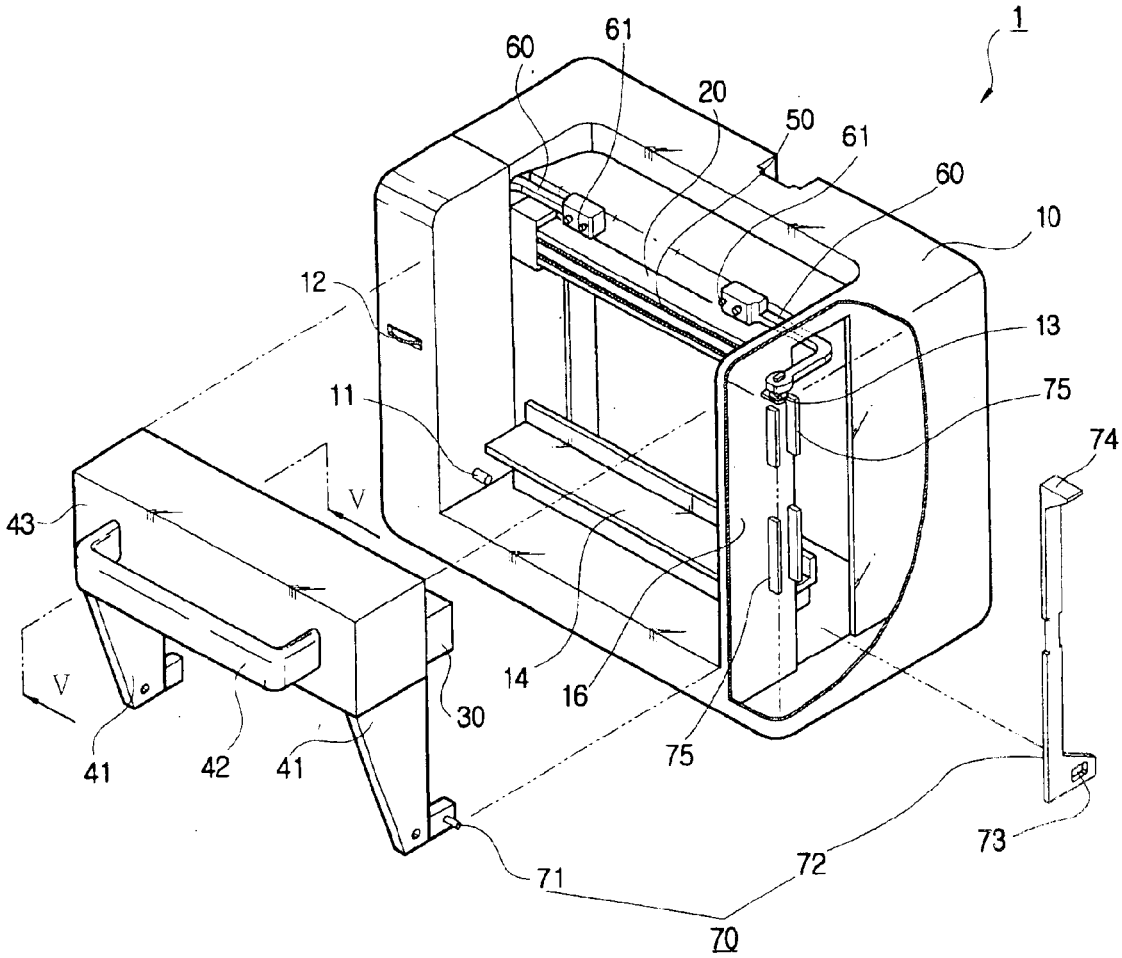
FIG. 3 is an exploded perspective view of the sealing machine in FIG. 1.

To at least one of the first and second sealing members 20 and 30 is provided the heater 50 for heating and melting the pack 90 when the movable supporting part 40 presses the second sealing member 30 against the first sealing member 20. For example, FIGS. 2 and 3 illustrate the heater 50 in the first sealing member 20. However, the heater 50 may be provided in the second sealing member 30 or in both the first and second sealing members 20 and 30. The heater 50 transforms electricity into heat energy by electrical resistance, thereby heating and melting the pack 90.

In the front of the main case 10 is a temperature controller 12 to allow a user to control the temperature of the heater 50 to properly seal the pack 90.

The grip parts 60 are placed between the first and second sealing members 20 and 30 inside the main case 10, and include a plurality of projections 61 on which a plurality of holes 91 (FIG. 6) formed on the upper corners of the pack 90 are placed. However, the grip parts 60 may include a clamp (not shown), rather than projections, to grasp the pack 90.

Figure 4A:
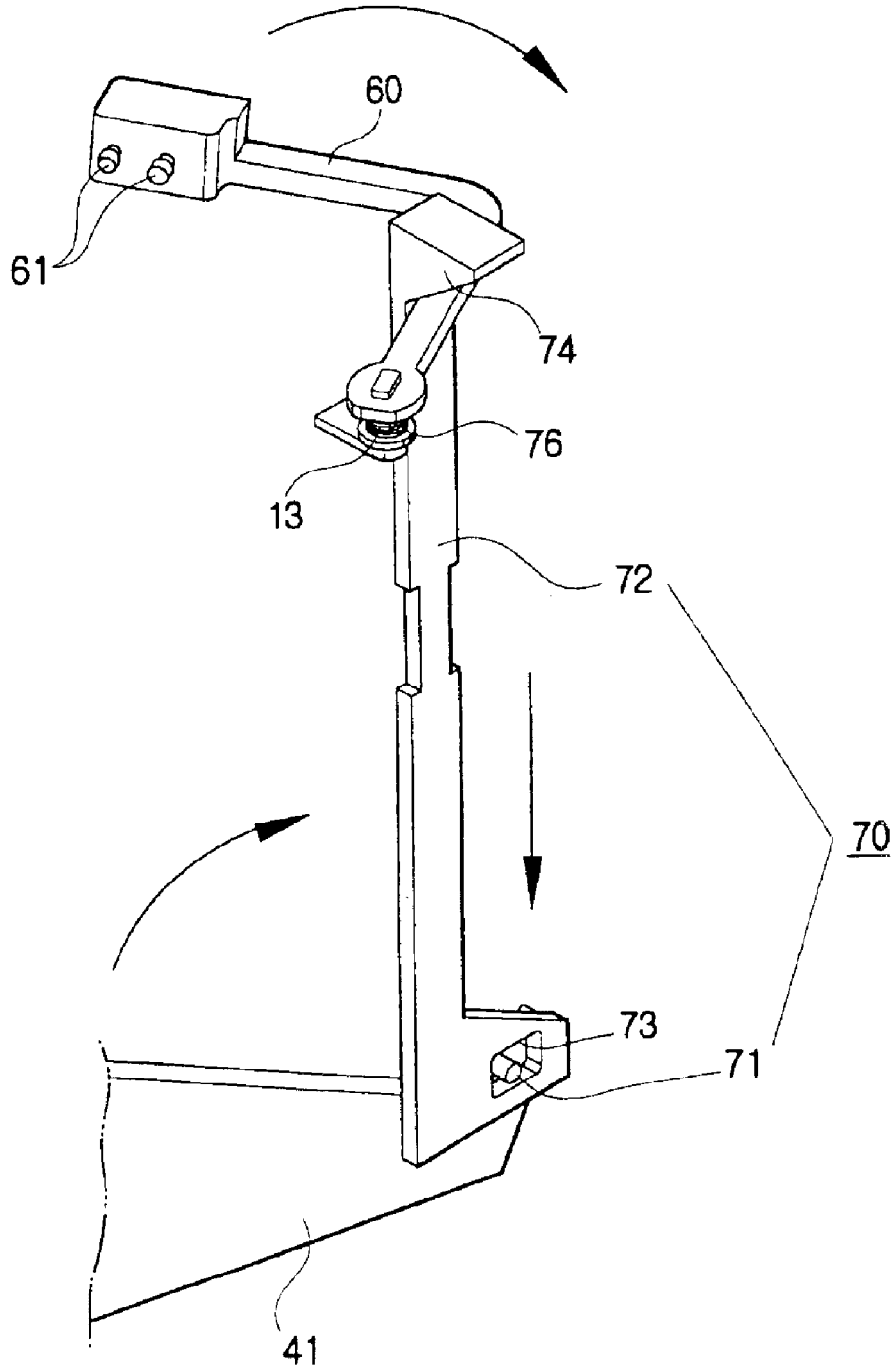
FIGS. 4A and 4B illustrate operation of a gearing part according to the embodiment of the present invention.
Figure 4B:
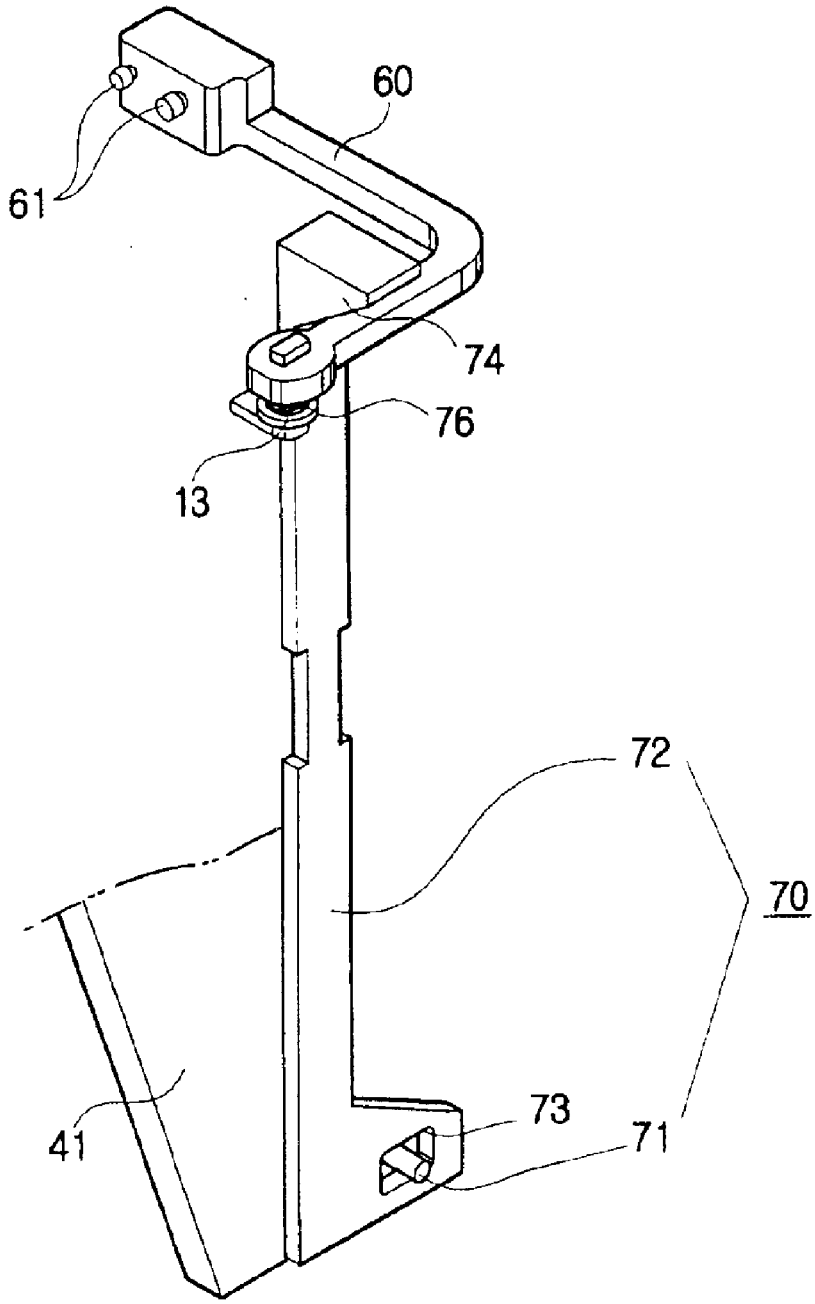

Referring to FIGS. 3, 4A, and 4B, the grip parts 60 are symmetrically placed in upper opposite sides of the main case 10, respectively, and can approach, and become distant from, each other. Each grip part 60 has an approximately "L"-shape, and includes a first end rotatably combined with a second hinge part 13 provided in the main case 10, and a second end provided with the projections 61 and disposed between the first and second sealing members 20 and 30.

Thus, with the grip parts 60 gripping the pack 90, the grip parts 60 may be rotated to approach one another and become distant from the first sealing member 20 see FIG. 2), so that a user can easily install the pack 90 onto the grip parts 60. Further, the upper end of the pack 90 is not tightly stretched at this point and the user may open the mouth of the pack 90 to easily insert objects such as raw materials for bread, etc. into the pack 90.

When the pack 90 is to be sealed, the grip parts 60 rotate to become distant from each other and approach the first sealing member 20 see FIG. 3), so that the pack 90 is hermetically sealed when the upper end thereof is tightly stretched.

As shown in FIG. 3, the sealing machine 1 further includes a pair of gearing parts 70 connecting the movable supporting part 40 with the grip parts 60 and rotating the grip parts 60 to become distant from one another when the second sealing member 30 moves toward the first sealing member 20.

The gearing parts 70 each includes a hinge pin 71 protruding from the lower part of a corresponding hinge bracket 41, and a gearing member 72 sliding up and down in the main case 10. The gearing member 72 is slidingly supported by a guide rib 75 protruding from the inner wall of the main case 10 along a sliding direction of the gearing member 72.

In the lower end of each gearing member 72 is a hole 73 accommodating one of the hinge pins 71 therein, so that the hinge pins 71 of the movable supporting part 40 move down when the second sealing member 30 provided in the movable supporting part 40 moves toward the first sealing member 20. In the upper end of each gearing member 72 is an inclined part 74 contacting an adjacent grip part 60, so that the inclined parts 74 push the grip parts 60 away from one another when the gearing members 72 move down. Hence, when the movable supporting part 40 rotates in a direction of moving the second sealing member 30 toward the first sealing member 20, the grip parts 60 become distant from one another by gearing with the rotation of the movable supporting part 40.

The second hinge part 13 includes a torsion spring 76 elastically biasing the grip parts 60 to approach one another. Hence, when the movable supporting part 40 rotates in a direction that moves the second sealing member 30 distantly from the first sealing member 20, the grip parts 60 approach one another by the elasticity of the torsion spring 76.

The sealing machine 1 according to the embodiment of the present invention operates as follows.

First, the projections 61 of the grip parts 60 are inserted into the holes 91 of the pack 90 when the second sealing member 30 of the movable supporting part 40 is positioned distantly from the first sealing member 20 and the grip parts 60 are positioned near one another.

After inserting an object in the pack 90, the movable supporting part 40 is rotated in a direction that moves the second sealing member 30 toward the first sealing member 20. At this time, the hinge pin 71 of the movable supporting part 40 that is inserted through the hole 73 of the gearing member 72 moves down, and the inclined part 74 of the gearing member 72 pushes the grip parts 60 away from one another by overcoming the elasticity of the torsion spring 76 (refer to FIGS. 4A and 4B).

As the second sealing member 30 moves toward the first sealing member 20, the pack 90 is placed in front of the first sealing member 20 such that an upper part of the pack 90 to be sealed is tightly stretched by the rotation of the grip parts 60, and the second sealing member 30 is pressed against the first sealing member 20. The upper end of the pack 90 is interposed between the first and second sealing members 20 and 30 and is heated and melted by the heater 50 in the first sealing member 20.

After an elapse of a predetermined period of time, the movable supporting part 40 is rotated in a direction that moves the second sealing member 30 distantly from the first sealing member 20. At this time, the grip parts 60 approach one another due to the elasticity of the torsion spring 76, so that the pack 90 is not tightly stretched, thereby allowing a user to easily remove the pack 90 from the grip parts 60.

Figure 5:
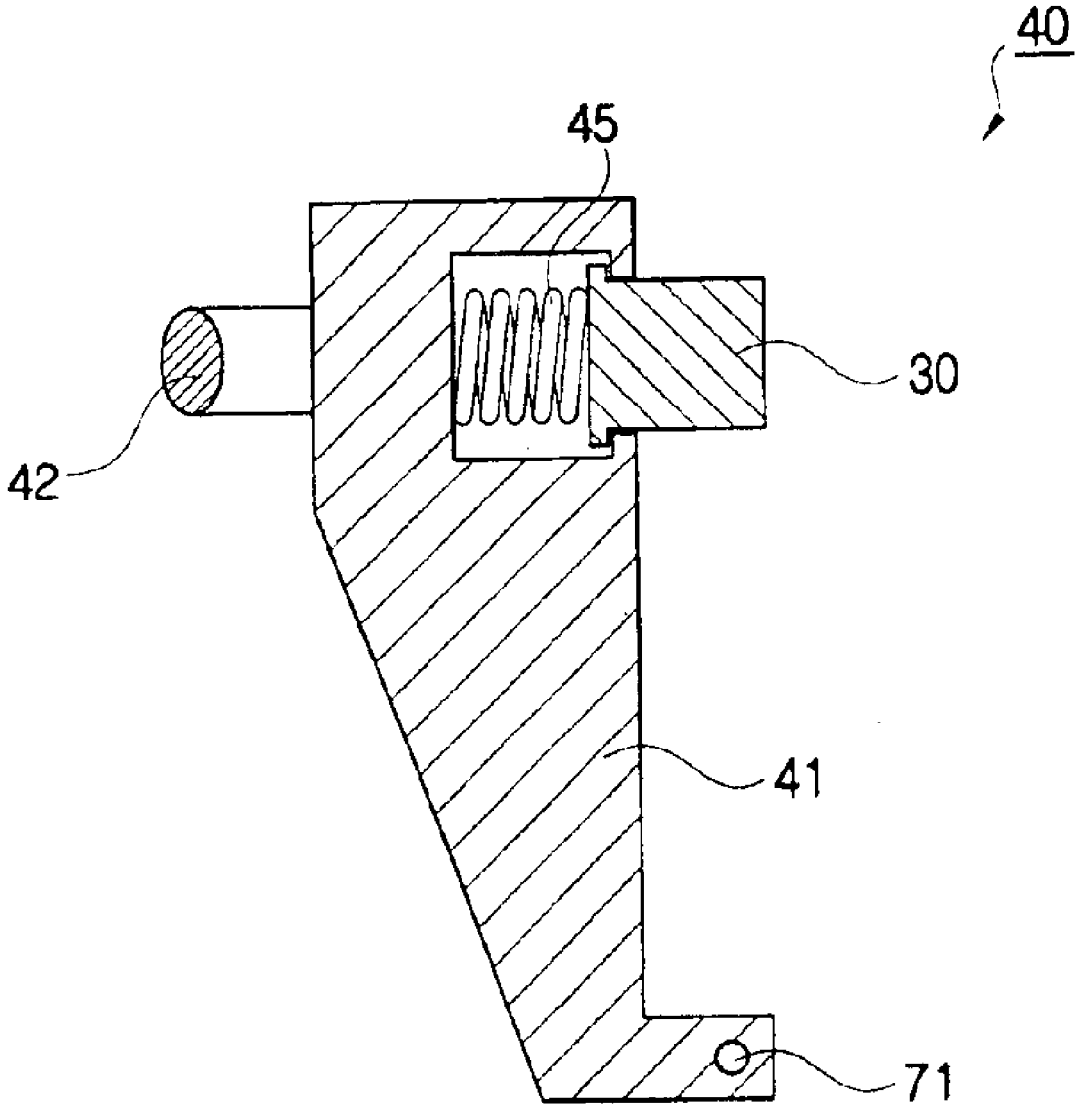
FIG. 5 is a sectional view of the sealing machine, taken along line V—V in FIG. 3.

Between the movable supporting part 40 and the second sealing member 30 is a spring member 45 elastically biasing the second sealing member 30 toward the first sealing member 20 (refer to FIG. 5). Hence, when the second sealing member 30 is pressed against the first sealing member 20, the spring member 45 effectively and evenly presses the second sealing member 30 against the first sealing member 20.

Figure 6:
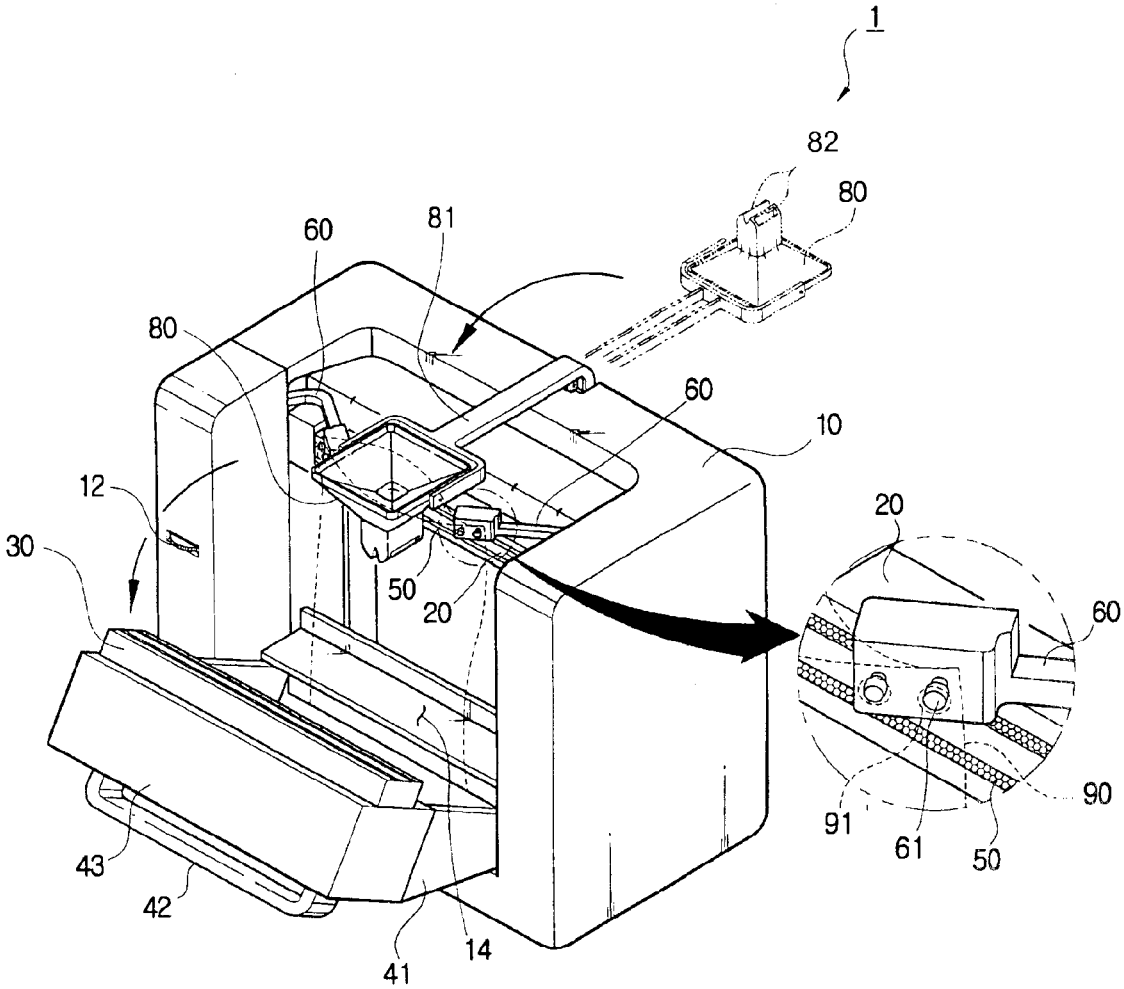
FIG. 6 is a perspective view of a sealing machine with an injection member according to another aspect of the present invention.

As shown in FIG. 6, the sealing machine 1 according to another aspect of the present invention includes an injection member 80 that is partially placed in the mouth of the pack 90 to insert an object into the pack 90 when the grip parts 60 are positioned near one another, and a rotatable supporting member 81 having a first end combined with the injection member 80 and a second end rotatably combined with the rear of the main case 10 to rotatably support the injection member 80. The injection member 80 is shaped like a funnel and has two outlets 82 to evenly insert an object, such as an ingredient, into the pack 90.

After installing the pack 90 to the grip parts 60 when the second sealing member 30 is positioned distantly from the first sealing member 20 and the grip parts 60 are positioned near one another, the rotatable supporting member 81 is forwardly rotated to put the outlets 82 of the injection member 80 into the mouth of the pack 90. Thereafter, an object is inserted into the pack 90 through the injection member 80. After an object is completely inserted into the pack 90, the rotatable supporting member 81 is backwardly rotated. Thus, when the pack 90 is installed in the sealing machine 1, an object is inserted into the pack 90 through the injection member 80 provided in the main case 10, so that a user can easily insert an object into the pack 90 without requiring a separate injection utensil.

As described above, the sealing machine 1 according to the embodiment of the present invention includes the main case 10; the first sealing member 20 in the main case 10; the second sealing member 30 facing the first sealing member 20; the movable supporting part 40 supporting the second sealing member 30 and allowing the second sealing member 30 to move near to, and distantly from, the first sealing member 20; the heater 50 in at least one of the first and second sealing members 20 and 30 for heating and melting the upper end of the pack 90, which is interposed between the first and second sealing members 20 and 30; and the pair of grip parts 60 between the first and second sealing members 20 and 30 for gripping the pack 90 so that the mouth of the pack 90 can be easily sealed. Further, the sealing machine 1 according to an aspect of the present invention includes the injection member 80, so that an object can be easily inserted into the pack 90.

As described above, the present invention provides a sealing machine by which anyone can easily insert an object into the pack and seal the pack.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A sealing machine for sealing a pack filled with one or more objects, comprising:

a main case;

a first sealing member provided in the main case;

a second sealing member facing the first sealing member;

a movable supporting part supporting the second sealing member and allowing the second sealing member to move near to, and away from, the first sealing member;

a heater provided in at least one of the first sealing member and the second sealing member to heat and melt a pack interposed therebetween;

a pair of grip parts moving near to and away from each other to grip the pack so that a portion of the pack is heated and sealed between the first and second sealing members; and gearing parts connecting the movable supporting part to the grip parts, and moving the grip parts away from each other when the second sealing member moves near to the first sealing member.

2. The sealing machine according to claim 1, wherein the heater is provided in the first sealing member.

3. The sealing machine according to claim 1, wherein the first sealing member and the second sealing member are supported by the main case and the movable supporting part, respectively, and the movable supporting part is rotatably combined to the main case to allow the second sealing member to move near to, and away from, the first sealing member.

4. The sealing machine according to claim 3, wherein the grip parts are each placed in upper opposite sides of the main case, and move near to and away from each other as the second sealing member moves away from and near to the first sealing member.

5. The sealing machine according to claim 4, wherein the grip parts move away from the first sealing member as the grip parts approach each other, and move near to the first sealing member as the grip parts move away from each other.

6. The sealing machine according to claim 1, wherein:

each gearing part includes a hinge pin protruding from a lower end of the movable supporting part, and a gearing member sliding up and down on a side wall of the main case, each gearing member includes a slot at a lower end of each gearing member and an inclined part at an upper end of each gearing member, each hinge pin being accommodated by a corresponding slot, as the movable supporting part rotates, the rotating motion of the movable supporting part is transformed into a sliding motion of each gearing member, and each inclined part contacts a corresponding grip part to transform the sliding motion of each gearing member into a rotating motion of each grip part.

7. The sealing machine according to claim 6, further comprising a first spring elastically biasing each grip part to approach one another.

8. The sealing machine according to claim 7, further comprising a second spring between the movable supporting part and the second sealing member to elastically bias the second sealing member toward the first sealing member.

9. The sealing machine according to claim 7, wherein when the movable supporting part is rotated to move the second sealing member toward the first sealing member, each hinge pin pulls down a corresponding gearing member, and the inclined part of each gearing member pushes the corresponding grip parts away from one another by overcoming the elasticity of the first spring.

10. The sealing machine according to claim 7, wherein when the movable supporting part is rotated to move the second sealing member away from the first sealing member, the elasticity of each first spring moves the grip parts toward one another to allow insertion, filling, and removal of the pack.

11. The sealing machine according to claim 1, further comprising:

an injection member partially placed in a mouth of the pack to insert the one or more objects into the pack when the grip parts are positioned near each other; and a rotatable supporting member having a first end combined with the injection member, and a second end rotatably combined with the main case to rotatably support the injection member.

12. The sealing machine according to claim 11, wherein the injection member has two outlets to evenly insert the one or more objects into the pack.

13. The sealing machine according to claim 1, wherein the grip parts are rotatable toward and away from each other, the pack has at least one hole at an end part thereof, and the grip parts have at least one projection corresponding to and receiving the at least one hole of the pack to attach the pack to the grip parts when the grip parts are rotated near each other.

14. The sealing machine according to claim 1, wherein the movable supporting part is combined with the main case, the movable supporting part sliding forward and backward to move near to, and away from, the first sealing member.

15. The sealing machine according to claim 1, further comprising a temperature controller in the front of the main case to allow a user to control a temperature of the heater when sealing the pack.

16. The sealing machine according to claim 1, wherein when the second sealing member moves toward the first sealing member, moving the grip parts away from each other, a upper end of the pack is tightly stretched to seal the pack.

* * * * *